US009611522B2

(12) United States Patent
Pandey

(10) Patent No.: US 9,611,522 B2
(45) Date of Patent: Apr. 4, 2017

(54) SPRAY DEPOSITION OF $L1_2$ ALUMINUM ALLOYS

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 415 days.

(21) Appl. No.: 12/436,395

(22) Filed: May 6, 2009

(65) Prior Publication Data

US 2010/0282428 A1 Nov. 11, 2010

(51) Int. Cl.
*C22F 1/04* (2006.01)
*C22C 21/00* (2006.01)

(52) U.S. Cl.
CPC .. *C22C 21/00* (2013.01); *C22F 1/04* (2013.01)

(58) Field of Classification Search
CPC ..... C22F 1/04; C22C 21/00–21/04
USPC ..... 148/437–440, 549–552, 688, 698–702; 419/1, 26, 29–31, 38–43, 48, 66–69; 420/529, 531–535, 537, 538, 540–553
See application file for complete search history.

(56) References Cited

U.S. PATENT DOCUMENTS

| | | | |
|---|---|---|---|
| 3,619,181 | A | 11/1971 | Willey et al. |
| 3,816,080 | A | 6/1974 | Bomford et al. |
| 4,041,123 | A | 8/1977 | Lange et al. |
| 4,259,112 | A | 3/1981 | Dolowy, Jr. et al. |
| 4,463,058 | A | 7/1984 | Hood et al. |
| 4,469,537 | A | 9/1984 | Ashton et al. |
| 4,499,048 | A | 2/1985 | Hanejko |
| 4,597,792 | A | 7/1986 | Webster |
| 4,626,294 | A | 12/1986 | Sanders, Jr. |
| 4,647,321 | A | 3/1987 | Adam |
| 4,661,172 | A | 4/1987 | Skinner et al. |
| 4,667,497 | A | 5/1987 | Oslin et al. |
| 4,689,090 | A | 8/1987 | Sawtell et al. |
| 4,710,246 | A | 12/1987 | Le Caer et al. |
| 4,713,216 | A | 12/1987 | Higashi et al. |
| 4,755,221 | A | 7/1988 | Paliwal et al. |
| 4,832,741 | A | 5/1989 | Couper |
| 4,834,810 | A | 5/1989 | Benn et al. |
| 4,834,942 | A | 5/1989 | Frazier et al. |
| 4,853,178 | A | 8/1989 | Oslin |

(Continued)

FOREIGN PATENT DOCUMENTS

| | | | |
|---|---|---|---|
| CN | 1436870 | A | 8/2003 |
| CN | 101025578 | A | 6/2008 |

(Continued)

OTHER PUBLICATIONS

Lawley et al. "Spray Forming." ASM Handbook, vol. 7: Powder Metal Technologies and Applications. pp. 396-407. 1998.*

(Continued)

*Primary Examiner* — Brian Walck
(74) *Attorney, Agent, or Firm* — Kinney & Lange, P.A.

(57) ABSTRACT

A method for producing high strength aluminum alloy product from powder containing $L1_2$ intermetallic dispersoids using high pressure gas atomization to deposit droplets on a substrate prior to complete solidification to form a billet. The sprayed deposit is hot worked using extrusion, forging and rolling to densify the structure by eliminating porosity, improving mechanical properties and to produce different shapes of components.

14 Claims, 6 Drawing Sheets

(56) References Cited

U.S. PATENT DOCUMENTS

| | | | |
|---|---|---|---|
| 4,865,806 | A | 9/1989 | Skibo et al. |
| 4,874,440 | A | 10/1989 | Sawtell et al. |
| 4,915,605 | A | 4/1990 | Chan et al. |
| 4,923,532 | A | 5/1990 | Zedalis et al. |
| 4,927,470 | A | 5/1990 | Cho |
| 4,933,140 | A | 6/1990 | Oslin |
| 4,946,517 | A | 8/1990 | Cho |
| 4,964,927 | A | 10/1990 | Shiflet et al. |
| 4,988,464 | A | 1/1991 | Riley |
| 5,032,352 | A | 7/1991 | Meeks et al. |
| 5,053,084 | A | 10/1991 | Masumoto et al. |
| 5,055,257 | A | 10/1991 | Chakrabarti et al. |
| 5,059,390 | A | 10/1991 | Burleigh et al. |
| 5,066,342 | A | 11/1991 | Rioja et al. |
| 5,076,340 | A | 12/1991 | Bruski et al. |
| 5,076,865 | A | 12/1991 | Hashimoto et al. |
| 5,130,209 | A | 7/1992 | Das et al. |
| 5,133,931 | A | 7/1992 | Cho |
| 5,198,045 | A | 3/1993 | Cho et al. |
| 5,211,910 | A | 5/1993 | Pickens et al. |
| 5,226,983 | A | 7/1993 | Skinner et al. |
| 5,256,215 | A | 10/1993 | Horimura |
| 5,308,410 | A | 5/1994 | Horimura et al. |
| 5,312,494 | A | 5/1994 | Horimura et al. |
| 5,318,641 | A | 6/1994 | Masumoto et al. |
| 5,397,403 | A | 3/1995 | Horimura et al. |
| 5,458,700 | A | 10/1995 | Masumoto et al. |
| 5,462,712 | A | 10/1995 | Langan et al. |
| 5,480,470 | A | 1/1996 | Miller et al. |
| 5,532,069 | A | 7/1996 | Masumoto et al. |
| 5,597,529 | A | 1/1997 | Tack |
| 5,620,652 | A | 4/1997 | Tack et al. |
| 5,624,632 | A | 4/1997 | Baumann et al. |
| 5,882,449 | A | 3/1999 | Waldron et al. |
| 6,139,653 | A | 10/2000 | Fernandes et al. |
| 6,149,737 | A | 11/2000 | Hattori et al. |
| 6,248,453 | B1 | 6/2001 | Watson |
| 6,254,704 | B1 | 7/2001 | Laul et al. |
| 6,258,318 | B1 | 7/2001 | Lenczowski et al. |
| 6,309,594 | B1 | 10/2001 | Meeks, III et al. |
| 6,312,643 | B1 | 11/2001 | Upadhya et al. |
| 6,315,948 | B1 | 11/2001 | Lenczowski et al. |
| 6,331,218 | B1 | 12/2001 | Inoue et al. |
| 6,355,209 | B1 | 3/2002 | Dilmore et al. |
| 6,368,427 | B1 | 4/2002 | Sigworth |
| 6,506,503 | B1 | 1/2003 | Mergen et al. |
| 6,517,954 | B1 | 2/2003 | Mergen et al. |
| 6,524,410 | B1 | 2/2003 | Kramer et al. |
| 6,531,004 | B1 | 3/2003 | Lenczowski et al. |
| 6,562,154 | B1 | 5/2003 | Rioja et al. |
| 6,630,008 | B1 | 10/2003 | Meeks, III et al. |
| 6,702,982 | B1 | 3/2004 | Chin et al. |
| 6,902,699 | B2 | 6/2005 | Fritzemeier et al. |
| 6,918,970 | B2 | 7/2005 | Lee et al. |
| 6,974,510 | B2 | 12/2005 | Watson |
| 7,048,815 | B2 | 5/2006 | Senkov et al. |
| 7,097,807 | B1 | 8/2006 | Meeks, III et al. |
| 7,241,328 | B2 | 7/2007 | Keener |
| 7,344,675 | B2 | 3/2008 | Van Daam et al. |
| 2001/0054247 | A1 | 12/2001 | Stall et al. |
| 2003/0192627 | A1 | 10/2003 | Lee et al. |
| 2004/0046402 | A1 | 3/2004 | Winardi |
| 2004/0055671 | A1 | 3/2004 | Olson et al. |
| 2004/0089382 | A1 | 5/2004 | Senkov et al. |
| 2004/0170522 | A1 | 9/2004 | Watson |
| 2004/0191111 | A1 | 9/2004 | Nie et al. |
| 2005/0013725 | A1 | 1/2005 | Hsiao |
| 2005/0147520 | A1 | 7/2005 | Canzona |
| 2006/0011272 | A1 | 1/2006 | Lin et al. |
| 2006/0093512 | A1 | 5/2006 | Pandey |
| 2006/0172073 | A1 | 8/2006 | Groza et al. |
| 2006/0269437 | A1 | 11/2006 | Pandey |
| 2007/0048167 | A1 | 3/2007 | Yano |
| 2007/0062669 | A1 | 3/2007 | Song et al. |
| 2008/0066833 | A1 | 3/2008 | Lin et al. |

FOREIGN PATENT DOCUMENTS

| | | | |
|---|---|---|---|
| EP | 0 208 631 | A1 | 6/1986 |
| EP | 0 584 596 | A2 | 3/1994 |
| EP | 1 111 079 | A1 | 6/2001 |
| EP | 1 249 303 | A1 | 10/2002 |
| EP | 1 170 394 | B1 | 4/2004 |
| EP | 1 439 239 | A1 | 7/2004 |
| EP | 1 471 157 | A1 | 10/2004 |
| EP | 1 111 078 | B1 | 9/2006 |
| EP | 1 788 102 | A1 | 5/2007 |
| EP | 1 728 881 | A2 | 12/2008 |
| EP | 2110452 | A1 | 10/2009 |
| FR | 2 656 629 | A1 | 12/1990 |
| FR | 2843754 | A1 | 2/2004 |
| JP | 04218638 | A | 8/1992 |
| JP | 9104940 | A | 4/1997 |
| JP | 9279284 | A | 10/1997 |
| JP | 11156584 | A | 6/1999 |
| JP | 2000119786 | A | 4/2000 |
| JP | 2001038442 | A | 2/2001 |
| JP | 2006248372 | A | 9/2006 |
| JP | 2007188878 | A | 7/2007 |
| KR | 20040067608 | A | 7/2004 |
| RU | 2001144 | C1 | 10/1993 |
| RU | 2001145 | C1 | 10/1993 |
| WO | 90 02620 | A1 | 3/1990 |
| WO | 91 10755 | A2 | 7/1991 |
| WO | 9111540 | A1 | 8/1991 |
| WO | 9532074 | A2 | 11/1995 |
| WO | WO9610099 | A1 | 4/1996 |
| WO | 9833947 | A1 | 8/1998 |
| WO | 00 37696 | A1 | 6/2000 |
| WO | 0112868 | A1 | 2/2001 |
| WO | 02 29139 | A2 | 4/2002 |
| WO | 03 052154 | A1 | 6/2003 |
| WO | 03085145 | A2 | 10/2003 |
| WO | 03085146 | A1 | 10/2003 |
| WO | 03 104505 | A2 | 12/2003 |
| WO | 2004 005562 | A2 | 1/2004 |
| WO | 2004046402 | A2 | 6/2004 |
| WO | 2004 045080 | A1 | 5/2005 |
| WO | 2005047554 | A1 | 5/2005 |

OTHER PUBLICATIONS

Cabbibo, M. et al., "A TEM study of the combined effect of severe plastic deformation and (Zr), (Sc+Zr)-containing dispersoids on an Al—Mg—Si alloy." Journal of Materials Science, vol. 41, Nol. 16, Jun. 6, 2006. pp. 5329-5338.

Litynska-Dobrzynska, L. "Effect of heat treatment on the sequence of phases formation in Al—Mg—Si alloy with Sc and Zr additions" Archives of Metallurgy and Materials. 51 (4), pp. 555-560, 2006.

Litynska-Dobrzynska, L. "Precipitation of Phases in Al—Mg—Si—Cu Alloy with Sc and Zr and Zr Additions During Heat Treatment" Diffusion and Defect Data, Solid State Data, Part B, Solid Statephenomena. vol. 130, No. Applied Crystallography, Jan. 1, 2007. pp. 163-166.

Cook, R., et al. "Aluminum and Aluminum Alloy Powders for P/M Applications." The Aluminum Powder Company Limited, Ceracon Inc.

"Aluminum and Aluminum Alloys." ASM Specialty Handbook. 1993. ASM International. p. 559.

Gangopadhyay, A.K., et al. "Effect of rare-earth atomic radius on the devitrification of AI88RE8Ni4 amorphous alloys." Philosophical Magazine A, 2000, vol. 80, No. 5, pp. 1193-1206.

Riddle, Y.W., et al. "Improving Recrystallization Resistance in WRought Aluminum Alloys with Scandium Addition." Lightweight Alloys for Aerospace Applications VI (pp. 26-39), 2001 TMS Annual Meeting, New Orleans, Louisiana, Feb. 11-15, 2001.

Baikowski Malakoff Inc. "The many uses of High Purity Alumina." Technical Specs. http://www.baikowskimalakoff.com/pdf/Rc-Ls.pdf (2005).

Lotsko, D.V., et al. "Effect of small additions of transition metals on the structure of Al—Zn—Mg—Zr—Sc alloys." New Level of Properties. Advances in Insect Physiology. Academic Press, vol. 2, Nov. 4, 2002. pp. 535-536.

(56) References Cited

OTHER PUBLICATIONS

Neikov, O.D., et al. "Properties of rapidly solidified powder aluminum alloys for elevated temperatures produced by water atomization." Advances in Powder Metallurgy & Particulate Materials. 2002. pp. 7-14-7-27.

Harada, Y. et al. "Microstructure of Al3Sc with ternary transition-metal additions." Materials Science and Engineering A329-331 (2002) 686-695.

Unal, A. et al. "Gas Atomization" from the section "Production of Aluminum and Aluminum-Alloy Powder" ASM Handbook, vol. 7. 2002.

Riddle, Y.W., et al. "A Study of Coarsening, Recrystallization, and Morphology of Microstructure in Al—Sc—(Zr)—(Mg) Alloys." Metallurgical and Materials Transactions A. vol. 35A, Jan. 2004. pp. 341-350.

Mil'Man, Y.V. et al. "Effect of Additional Alloying with Transition Metals on the STructure of an Al—7.1 Zn—1.3 Mg—0.12 Zr Alloy." Metallofizika I Noveishie Teknohologii, 26 (10), 1363-1378, 2004.

Tian, N. et al. "Heating rate dependence of glass transition and primary crystallization of Al88Gd6Er2Ni4 metallic glass." Scripta Materialia 53 (2005) pp. 681-685.

Litynska, L. et al. "Experimental and theoretical characterization of Al3Sc precipitates in Al—Mg—Si—Cu—Sc—Zr alloys." Zeitschrift Fur Metallkunde. vol. 97, No. 3. Jan. 1, 2006. pp. 321-324.

Rachek, O.P. "X-ray diffraction study of amorphous alloys Al—Ni—Ce—Sc with using Ehrenfest's formula." Journal of Non-Crystalline Solids 352 (2006) pp. 3781-3786.

Pandey A B et al, "High Strength Discontinuously Reinforced Aluminum for Rocket Applications," Affordable Metal Matrix Composites for High Performance Applications. Symposia Proceedings, TMS (The Minerals, Metals & Materials Society), US, No. 2nd, Jan. 1, 2008, pp. 3-12.

Niu, Ben et al. "Influence of addition of 1-15 erbium on microstructure and crystallization behavior of Al—Ni—Y amorphous alloy" Zhongguo Xitu Xuebao, 26(4), pp. 450-454. 2008.

Riddle, Y.W., et al. "Recrystallization Performance of AA7050 Varied with Sc and Zr." Materials Science Forum. 2000. pp. 799-804.

Lotsko, D.V., et al. "High-strength aluminum-based alloys hardened by quasicrystalline nanoparticles." Science for Materials in the Frontier of Centuries: Advantages and Challenges, International Conference: Kyiv, Ukraine. Nov. 4-8, 2002. vol. 2. pp. 371-372.

Hardness Conversion Table. Downloaded from http://www.gordonengland.co.uk/hardness/hardness_conversion_2m.htm.

ASM Handbook, vol. 7, ASM International, materials Park, OH (1998) p. 396.

* cited by examiner

SPRAY DEPOSITION OF $L1_2$ ALUMINUM ALLOYS

CROSS-REFERENCE TO RELATED APPLICATION(S)

This application is related to the following co-pending applications that were filed on Dec. 9, 2008 herewith and are assigned to the same assignee: CONVERSION PROCESS FOR HEAT TREATABLE $L1_2$ ALUMINUM ALLOYS, Ser. No. 12/316,020; A METHOD FOR FORMING HIGH STRENGTH ALUMINUM ALLOYS CONTAINING $L1_2$ INTERMETALLIC DISPERSOIDS, Ser. No. 12/316,046; and A METHOD FOR PRODUCING HIGH STRENGTH ALUMINUM ALLOY POWDER CONTAINING $L1_2$ INTERMETALLIC DISPERSOIDS, Ser. No. 12/316,047.

This application is also related to the following co-pending applications that were filed on Apr. 18, 2008, and are assigned to the same assignee: $L1_2$ ALUMINUM ALLOYS WITH BIMODAL AND TRIMODAL DISTRIBUTION, Ser. No. 12/148,395; DISPERSION STRENGTHENED $L1_2$ ALUMINUM ALLOYS, Ser. No. 12/148,432; HEAT TREATABLE $L1_2$ ALUMINUM ALLOYS, Ser. No. 12/148,383; HIGH STRENGTH $L1_2$ ALUMINUM ALLOYS, Ser. No. 12/148,394; HIGH STRENGTH $L1_2$ ALUMINUM ALLOYS, Ser. No. 12/148,382; HEAT TREATABLE $L1_2$ ALUMINUM ALLOYS, Ser. No. 12/148,396; HIGH STRENGTH $L1_2$ ALUMINUM ALLOYS, Ser. No. 12/148,387; HIGH STRENGTH ALUMINUM ALLOYS WITH $L1_2$ PRECIPITATES, Ser. No. 12/148,426; HIGH STRENGTH $L1_2$ ALUMINUM ALLOYS, Ser. No. 12/148,459; and $L1_2$ STRENGTHENED AMORPHOUS ALUMINUM ALLOYS, Ser. No. 12/148,458.

BACKGROUND

The present invention relates generally to aluminum alloys and more specifically to a method for forming high strength aluminum alloy product having $L1_2$ dispersoids therein.

The combination of high strength, ductility, and fracture toughness, as well as low density, make aluminum alloys natural candidates for aerospace and space applications. However, their use is typically limited to temperatures below about 300° F. (149° C.) since most aluminum alloys start to lose strength in that temperature range as a result of coarsening of strengthening precipitates.

The development of aluminum alloys with improved elevated temperature mechanical properties is a continuing process. Some attempts have included aluminum-iron and aluminum-chromium based alloys such as Al—Fe—Ce, Al—Fe—V—Si, Al—Fe—Ce—W, and Al—Cr—Zr—Mn that contain incoherent dispersoids. These alloys, however, also lose strength at elevated temperatures due to particle coarsening. In addition, these alloys exhibit ductility and fracture toughness values lower than other commercially available aluminum alloys.

Other attempts have included the development of mechanically alloyed Al—Mg and Al—Ti alloys containing ceramic dispersoids. These alloys exhibit improved high temperature strength due to the particle dispersion, but the ductility and fracture toughness are not improved.

U.S. Pat. No. 6,248,453 owned by the assignee of the present invention discloses aluminum alloys strengthened by dispersed $Al_3X$ $L1_2$ intermetallic phases where X is selected from the group consisting of Sc, Er, Lu, Yb, Tm, and Lu. The $Al_3X$ particles are coherent with the aluminum alloy matrix and are resistant to coarsening at elevated temperatures. The improved mechanical properties of the disclosed dispersion strengthened $L1_2$ aluminum alloys are stable up to 572° F. (300° C.). U.S. Patent Application Publication No. 2006/0269437 A1 also owned commonly discloses a high strength aluminum alloy that contains scandium and other elements that is strengthened by $L1_2$ dispersoids.

$L1_2$ strengthened aluminum alloys have high strength and improved fatigue properties compared to commercially available aluminum alloys. Fine grain size results in improved mechanical properties of materials. Hall-Petch strengthening has been known for decades where strength increases as grain size decreases. An optimum grain size for optimum strength is in the nano range of about 30 to 100 nm. These alloys also have higher ductility. Fine interparticle spacing provides higher yield strength through Orowan dislocation-particle interaction model. Fine interparticle spacing is achieved by controlling the precipitate particles to fine size for a given volume fraction.

SUMMARY

The present invention is a method for forming aluminum alloys with high strength and fracture toughness. In embodiments, the alloys have coherent $L1_2$ $Al_3X$ dispersoids where X is at least one first element selected from scandium, erbium, thulium, ytterbium, and lutetium, and at least one second element selected from gadolinium, yttrium, zirconium, titanium, hafnium, and niobium. The balance is substantially aluminum containing at least one alloying element selected from silicon, magnesium, lithium, copper, zinc, and nickel.

The alloys are formed by spray deposition in which a stream of molten aluminum alloy containing $L1_2$ dispersoid forming elements is contacted with high velocity inert gas stream to form liquid droplets that are directed toward a substrate. The droplets solidify upon impact and form a solid deposit with a low degree of porosity. The aluminum alloy product thus formed can be deformation processed and heat treated to develop improved strength and fracture toughness. The method is efficient because melting and consolidation are combined in a single step. In addition, the rapid cooling rate experienced during droplet flight and impact leads to high supersaturation of solute and an increased amount of metastable $L1_2$ dispersoids in the aged alloys.

DETAILED DESCRIPTION

1. $L1_2$ Aluminum Alloys

Figure 1:
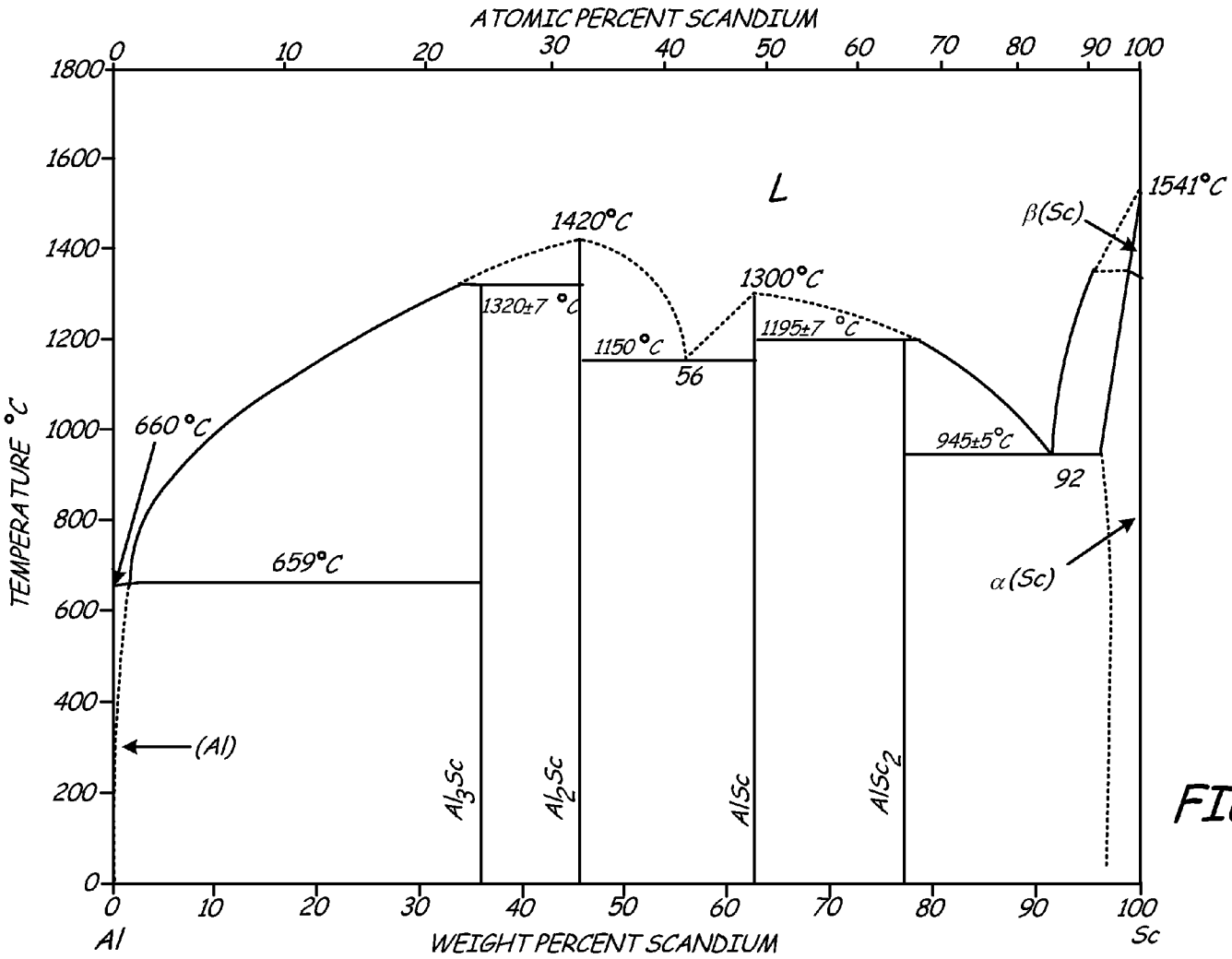
FIG. 1 is an aluminum scandium phase diagram.

The alloy products of this invention are formed from aluminum based alloys with high strength and fracture toughness for applications at temperatures from about −420° F. (−251° C.) up to about 650° F. (343° C.). The aluminum alloy comprises a solid solution of aluminum and at least one element selected from silicon, magnesium, lithium, copper, zinc, and nickel strengthened by $L1_2$ coherent precipitates where X is at least one first element selected from scandium, erbium, thulium, ytterbium, and lutetium, and at least one second element selected from gadolinium, yttrium, zirconium, titanium, hafnium, and niobium.

The aluminum silicon system is a simple eutectic alloy system with a eutectic reaction at 12.5 weight percent silicon and 1077° F. (577° C.). There is little solubility of silicon in aluminum at temperatures up to 930° F. (500° C.) and none of aluminum in silicon. However, the solubility can be extended significantly by utilizing rapid solidification techniques The binary aluminum magnesium system is a simple eutectic at 36 weight percent magnesium and 842° F. (450° C.). There is complete solubility of magnesium and aluminum in the rapidly solidified inventive alloys discussed herein The binary aluminum lithium system is a simple eutectic at 8 weight percent lithium and 1105° (596° C.). The equilibrium solubility of 4 weight percent lithium can be extended significantly by rapid solidification techniques. There can be complete solubility of lithium in the rapidly solidified inventive alloys discussed herein.

The binary aluminum copper system is a simple eutectic at 32 weight percent copper and 1018° F. (548° C.). There can be complete solubility of copper in the rapidly solidified inventive alloys discussed herein.

The aluminum zinc binary system is a eutectic alloy system involving a monotectoid reaction and a miscibility gap in the solid state. There is a eutectic reaction at 94 weight percent zinc and 718° F. (381° C.). Zinc has maximum solid solubility of 83.1 weight percent in aluminum at 717.8° F. (381° C.) which can be extended by rapid solidification processes. Decomposition of the supersaturated solid solution of zinc in aluminum gives rise to spherical and ellipsoidal GP zones which are coherent with the matrix and act to strengthen the alloy.

The aluminum nickel binary system is a simple eutectic at 5.7 weight percent nickel and 1183.8° F. (639.9° C.). There is little solubility of nickel in aluminum. However, the solubility can be extended significantly by utilizing rapid solidification processes. The equilibrium phase in the aluminum nickel eutectic system is $L1_2$ intermetallic $Al_3Ni$.

In the aluminum based alloys disclosed herein, scandium, erbium, thulium, ytterbium, and lutetium are potent strengtheners that have low diffusivity and low solubility in aluminum. All these elements form equilibrium $Al_3X$ intermetallic dispersoids where X is at least one of scandium, erbium, thulium, ytterbium, and lutetium, that have an $L1_2$ structure that is an ordered face centered cubic structure with the X atoms located at the corners and aluminum atoms located on the cube faces of the unit cell.

Scandium forms $Al_3Sc$ dispersoids that are fine and coherent with the aluminum matrix. Lattice parameters of aluminum and $Al_3Sc$ are very close (0.405 nm and 0.410 nm respectively), indicating that there is minimal or no driving force for causing growth of the $Al_3Sc$ dispersoids. This low interfacial energy makes the $Al_3Sc$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Sc$ to coarsening. Additions of zinc, copper, lithium, silicon, and nickel provide solid solution and precipitation strengthening in the aluminum alloys. In the alloys of this invention these $Al_3Sc$ dispersoids are made stronger and more resistant to coarsening at elevated temperatures by adding suitable alloying elements such as gadolinium, yttrium, zirconium, titanium, hafnium, niobium, or combinations that enter $Al_3Sc$ in solution.

Erbium forms $Al_3Er$ dispersoids in the aluminum matrix that are fine and coherent with the aluminum matrix. The lattice parameters of aluminum and $Al_3Er$ are close (0.405 nm and 0.417 nm respectively), indicating there is minimal driving force for causing growth of the $Al_3Er$ dispersoids. This low interfacial energy makes the $Al_3Er$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Er$ to coarsening. Additions of zinc, copper, lithium, silicon, and nickel provide solid solution and precipitation strengthening in the aluminum alloys. In the alloys of this invention, these $Al_3Er$ dispersoids are made stronger and more resistant to coarsening at elevated temperatures by adding suitable alloying elements such as gadolinium, yttrium, zirconium, titanium, hafnium, niobium, or combinations thereof that enter $Al_3Er$ in solution.

Thulium forms metastable $Al_3Tm$ dispersoids in the aluminum matrix that are fine and coherent with the aluminum matrix. The lattice parameters of aluminum and $Al_3Tm$ are close (0.405 nm and 0.420 nm respectively), indicating there is minimal driving force for causing growth of the $Al_3Tm$ dispersoids. This low interfacial energy makes the $Al_3Tm$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Tm$ to coarsening. Additions of zinc, copper, lithium, silicon, and nickel provide solid solution and precipitation strengthening in the aluminum alloys. In the alloys of this invention these $Al_3Tm$ dispersoids are made stronger and more resistant to coarsening at elevated temperatures by adding suitable alloying elements such as gadolinium, yttrium, zirconium, titanium, hafnium, niobium, or combinations thereof that enter $Al_3Tm$ in solution.

Ytterbium forms $Al_3Yb$ dispersoids in the aluminum matrix that are fine and coherent with the aluminum matrix. The lattice parameters of Al and $Al_3Yb$ are close (0.405 nm and 0.420 nm respectively), indicating there is minimal driving force for causing growth of the $Al_3Yb$ dispersoids. This low interfacial energy makes the $Al_3Yb$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Yb$ to coarsening. Additions of zinc, copper, lithium, silicon, and nickel provide solid solution and precipitation strengthening in the aluminum alloys. In the alloys of this invention, these $Al_3Yb$ dispersoids are made stronger and more resistant to coarsening at elevated temperatures by adding suitable alloying elements such as gadolinium, yttrium, zirconium, titanium, hafnium, niobium, or combinations thereof that enter $Al_3Yb$ in solution.

Lutetium forms $Al_3Lu$ dispersoids in the aluminum matrix that are fine and coherent with the aluminum matrix. The lattice parameters of Al and $Al_3Lu$ are close (0.405 nm and 0.419 nm respectively), indicating there is minimal driving force for causing growth of the $Al_3Lu$ dispersoids. This low interfacial energy makes the $Al_3Lu$ dispersoids thermally stable and resistant to coarsening up to temperatures as high as about 842° F. (450° C.). Additions of magnesium in aluminum increase the lattice parameter of the aluminum matrix, and decrease the lattice parameter mismatch further increasing the resistance of the $Al_3Lu$ to coarsening. Additions of zinc, copper, lithium, silicon, and nickel provide solid solution and precipitation strengthening in the aluminum alloys. In the alloys of this invention, these $Al_3Lu$ dispersoids are made stronger and more resistant to coarsening at elevated temperatures by adding suitable alloying elements such as gadolinium, yttrium, zirconium, titanium, hafnium, niobium, or mixtures thereof that enter $Al_3Lu$ in solution.

Gadolinium forms metastable $Al_3Gd$ dispersoids in the aluminum matrix that are stable up to temperatures as high as about 842° F. (450° C.) due to their low diffusivity in aluminum. The $Al_3Gd$ dispersoids have a $D0_{19}$ structure in the equilibrium condition. Despite its large atomic size, gadolinium has fairly high solubility in the $Al_3X$ intermetallic dispersoids (where X is scandium, erbium, thulium, ytterbium or lutetium). Gadolinium can substitute for the X atoms in $Al_3X$ intermetallic, thereby forming an ordered $L1_2$ phase which results in improved thermal and structural stability.

Yttrium forms metastable $Al_3Y$ dispersoids in the aluminum matrix that have an $L1_2$ structure in the metastable condition and a $D0_{19}$ structure in the equilibrium condition. The metastable $Al_3Y$ dispersoids have a low diffusion coefficient which makes them thermally stable and highly resistant to coarsening. Yttrium has a high solubility in the $Al_3X$ intermetallic dispersoids allowing large amounts of yttrium to substitute for X in the $Al_3X$ $L1_2$ dispersoids which results in improved thermal and structural stability.

Zirconium forms $Al_3Zr$ dispersoids in the aluminum matrix that have an $L1_2$ structure in the metastable condition and $D0_{23}$ structure in the equilibrium condition. The metastable $Al_3Zr$ dispersoids have a low diffusion coefficient which makes them thermally stable and highly resistant to coarsening. Zirconium has a high solubility in the $Al_3X$ dispersoids allowing large amounts of zirconium to substitute for X in the $Al_3X$ dispersoids, which results in improved thermal and structural stability.

Titanium forms $Al_3Ti$ dispersoids in the aluminum matrix that have an $L1_2$ structure in the metastable condition and $DO_{22}$ structure in the equilibrium condition. The metastable $Al_3Ti$ despersoids have a low diffusion coefficient which makes them thermally stable and highly resistant to coarsening. Titanium has a high solubility in the $Al_3X$ dispersoids allowing large amounts of titanium to substitute for X in the $Al_3X$ dispersoids, which results in improved thermal and structural stability.

Hafnium forms metastable $Al_3Hf$ dispersoids in the aluminum matrix that have an $L1_2$ structure in the metastable condition and a $D0_{23}$ structure in the equilibrium condition. The $Al_3Hf$ dispersoids have a low diffusion coefficient, which makes them thermally stable and highly resistant to coarsening. Hafnium has a high solubility in the $Al_3X$ dispersoids allowing large amounts of hafnium to substitute for scandium, erbium, thulium, ytterbium, and lutetium in the above mentioned $Al_3X$ dispersoids, which results in stronger and more thermally stable dispersoids.

Niobium forms metastable $Al_3Nb$ dispersoids in the aluminum matrix that have an $L1_2$ structure in the metastable condition and a $D0_{22}$ structure in the equilibrium condition. Niobium has a lower solubility in the $Al_3X$ dispersoids than hafnium or yttrium, allowing relatively lower amounts of niobium than hafnium or yttrium to substitute for X in the $Al_3X$ dispersoids. Nonetheless, niobium can be very effective in slowing down the coarsening kinetics of the $Al_3X$ dispersoids because the $Al_3Nb$ dispersoids are thermally stable. The substitution of niobium for X in the above mentioned $Al_3X$ dispersoids results in stronger and more thermally stable dispersoids.

$Al_3X$ $L1_2$ precipitates improve elevated temperature mechanical properties in aluminum alloys for two reasons. First, the precipitates are ordered intermetallic compounds. As a result, when the particles are sheared by glide dislocations during deformation, the dislocations separate into two partial dislocations separated by an anti-phase boundary on the glide plane. The energy to create the anti-phase boundary is the origin of the strengthening. Second, the cubic $L1_2$ crystal structure and lattice parameter of the precipitates are closely matched to the aluminum solid solution matrix. This results in a lattice coherency at the precipitate/matrix boundary that resists coarsening. The lack of an interphase boundary results in a low driving force for particle growth and resulting elevated temperature stability. Alloying elements in solid solution in the dispersed strengthening particles and in the aluminum matrix that tend to decrease the lattice mismatch between the matrix and particles will tend to increase the strengthening and elevated temperature stability of the alloy.

$L1_2$ phase strengthened aluminum alloys are important structural materials because of their excellent mechanical properties and the stability of these properties at elevated temperature due to the resistance of the coherent dispersoids in the microstructure to particle coarsening. The mechanical properties are optimized by maintaining a high volume fraction of $L1_2$ dispersoids in the microstructure. The $L1_2$ dispersoid concentration following aging scales as the amount of $L1_2$ phase forming elements in solid solution in the aluminum alloy following quenching. Examples of $L1_2$ phase forming elements include but are not limited to Sc, Er, Th, Yb, and Lu. The concentration of alloying elements in solid solution in alloys cooled from the melt is directly proportional to the cooling rate.

Exemplary aluminum alloys for system alloys of this invention include, but are not limited to (in weight percent unless otherwise specified):

about Al-M-(0.1-4)Sc-(0.1-20)Gd;
about Al-M-(0.1-20)Er-(0.1-20)Gd;
about Al-M-(0.1-15)Tm-(0.1-20)Gd;
about Al-M-(0.1-25)Yb-(0.1-20)Gd;
about Al-M-(0.1-25)Lu-(0.1-20)Gd;
about Al-M-(0.1-4)Sc-(0.1-20)Y;
about Al-M-(0.1-20)Er-(0.1-20)Y;
about Al-M-(0.1-15)Tm-(0.1-20)Y;
about Al-M-(0.1-25)Yb-(0.1-20)Y;
about Al-M-(0.1-25)Lu-(0.1-20)Y;
about Al-M-(0.1-4)Sc-(0.05-4)Zr;
about Al-M-(0.1-20)Er-(0.05-4)Zr;
about Al-M-(0.1-15)Tm-(0.05-4)Zr;
about Al-M-(0.1-25)Yb-(0.05-4)Zr;
about Al-M-(0.1-25)Lu-(0.05-4)Zr;
about Al-M-(0.1-4)Sc-(0.05-10)Ti;
about Al-M-(0.1-20)Er-(0.05-10)Ti;
about Al-M-(0.1-15)Tm-(0.05-10)Ti;
about Al-M-(0.1-25)Yb-(0.05-10)Ti;
about Al-M-(0.1-25)Lu-(0.05-10)Ti;
about Al-M-(0.1-4)Sc-(0.05-10)Hf;
about Al-M-(0.1-20)Er-(0.05-10)Hf;
about Al-M-(0.1-15)Tm-(0.05-10)Hf;
about Al-M-(0.1-25)Yb-(0.05-10)Hf;
about Al-M-(0.1-25)Lu-(0.05-10)Hf;
about Al-M-(0.1-4)Sc-(0.05-5)Nb;
about Al-M-(0.1-20)Er-(0.05-5)Nb;
about Al-M-(0.1-15)Tm-(0.05-5)Nb;
about Al-M-(0.1-25)Yb-(0.05-5)Nb; and
about Al-M-(0.1-25)Lu-(0.05-5)Nb.

M is at least one of about (4-25) weight percent silicon, (1-8) weight percent magnesium, (0.5-3) weight percent lithium, (0.2-6.5) weight percent copper, (3-12) weight percent zinc, and (1-12) weight percent nickel.

The amount of silicon present in the fine grain matrix of this invention if any may vary from about 4 to about 25 weight percent, more preferably from about 4 to about 18 weight percent, and even more preferably from about 5 to about 11 weight percent.

The amount of magnesium present in the fine grain matrix of this invention if any may vary from about 1 to about 8 weight percent, more preferably from about 3 to about 7.5 weight percent, and even more preferably from about 4 to about 6.5 weight percent.

The amount of lithium present in the fine grain matrix of this invention if any may vary from about 0.5 to about 3 weight percent, more preferably from about 1 to about 2.5 weight percent, and even more preferably from about 1 to about 2 weight percent.

The amount of copper present in the fine grain matrix of this invention if any may vary from about 0.2 to about 6.5 weight percent, more preferably from about 0.5 to about 5.0 weight percent, and even more preferably from about 2 to about 4.5 weight percent.

The amount of zinc present in the fine grain matrix of this invention if any may vary from about 3 to about 12 weight percent, more preferably from about 4 to about 10 weight percent, and even more preferably from about 5 to about 9 weight percent.

The amount of nickel present in the fine grain matrix of this invention if any may vary from about 1 to about 12 weight percent, more preferably from about 2 to about 10 weight percent, and even more preferably from about 4 to about 10 weight percent.

The amount of scandium present in the fine grain matrix of this invention if any may vary from 0.1 to about 4 weight percent, more preferably from about 0.1 to about 3 weight percent, and even more preferably from about 0.2 to about 2.5 weight percent. The Al—Sc phase diagram shown in FIG. 1 indicates a eutectic reaction at about 0.5 weight percent scandium at about 1219° F. (659° C.) resulting in a solid solution of scandium and aluminum and $Al_3Sc$ dispersoids. Aluminum alloys with less than 0.5 weight percent scandium can be quenched from the melt to retain scandium in solid solution that may precipitate as dispersed $L1_2$ intermetallic $Al_3Sc$ following an aging treatment. Alloys with scandium in excess of the eutectic composition (hypereutectic alloys) can only retain scandium in solid solution by rapid solidification processing (RSP) where cooling rates are in excess of about $10^{3}$° C./second.

Figure 2:
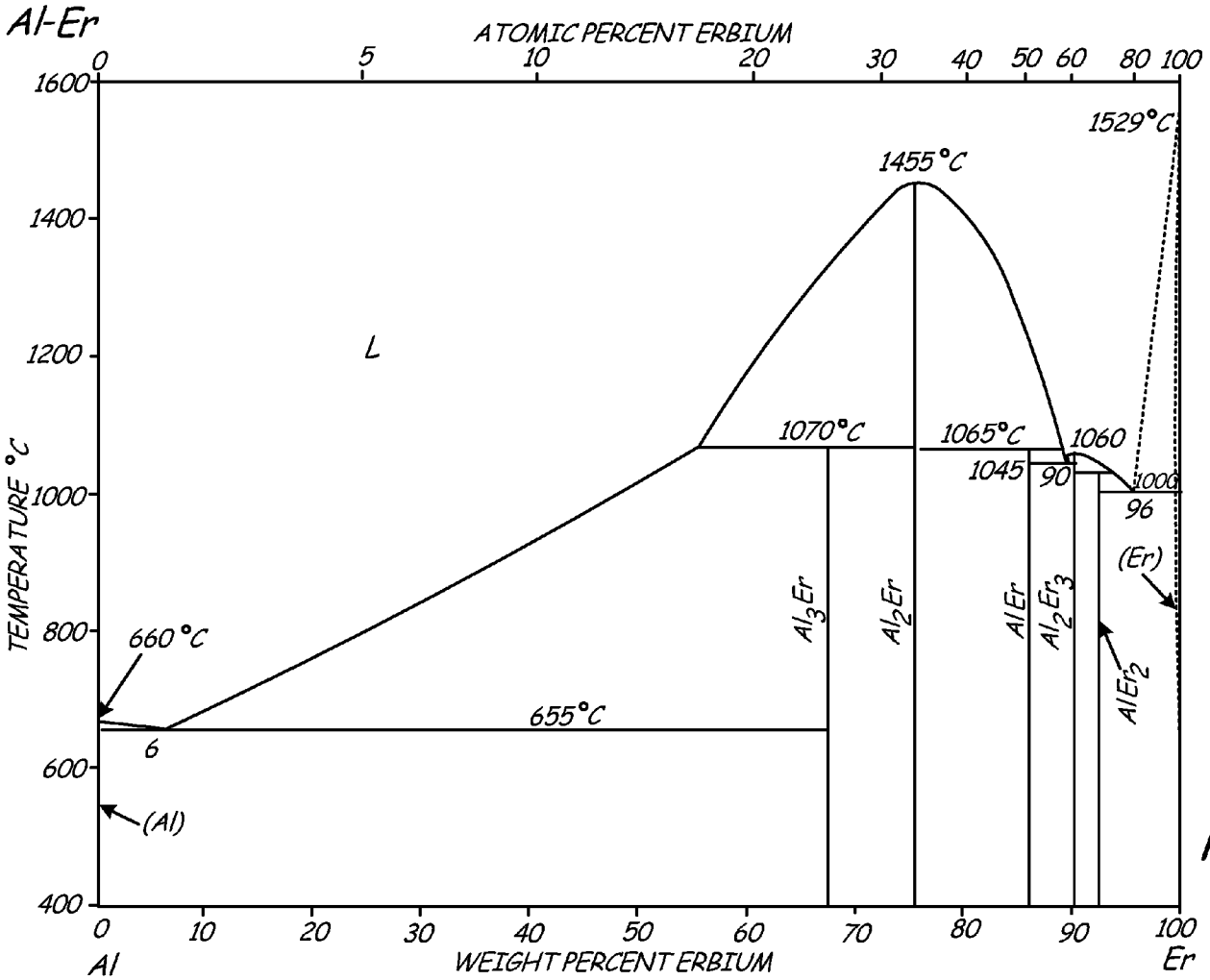
FIG. 2 is an aluminum erbium phase diagram.

The amount of erbium present in the fine grain matrix of this invention, if any, may vary from about 0.1 to about 20 weight percent, more preferably from about 0.3 to about 15 weight percent, and even more preferably from about 0.5 to about 10 weight percent. The Al—Er phase diagram shown in FIG. 2 indicates a eutectic reaction at about 6 weight percent erbium at about 1211° F. (655° C.). Aluminum alloys with less than about 6 weight percent erbium can be quenched from the melt to retain erbium in solid solutions that may precipitate as dispersed $L1_2$ intermetallic $Al_3Er$ following an aging treatment. Alloys with erbium in excess of the eutectic composition can only retain erbium in solid solution by rapid solidification processing (RSP) where cooling rates are in excess of about $10^{3}$° C./second.

Figure 3:
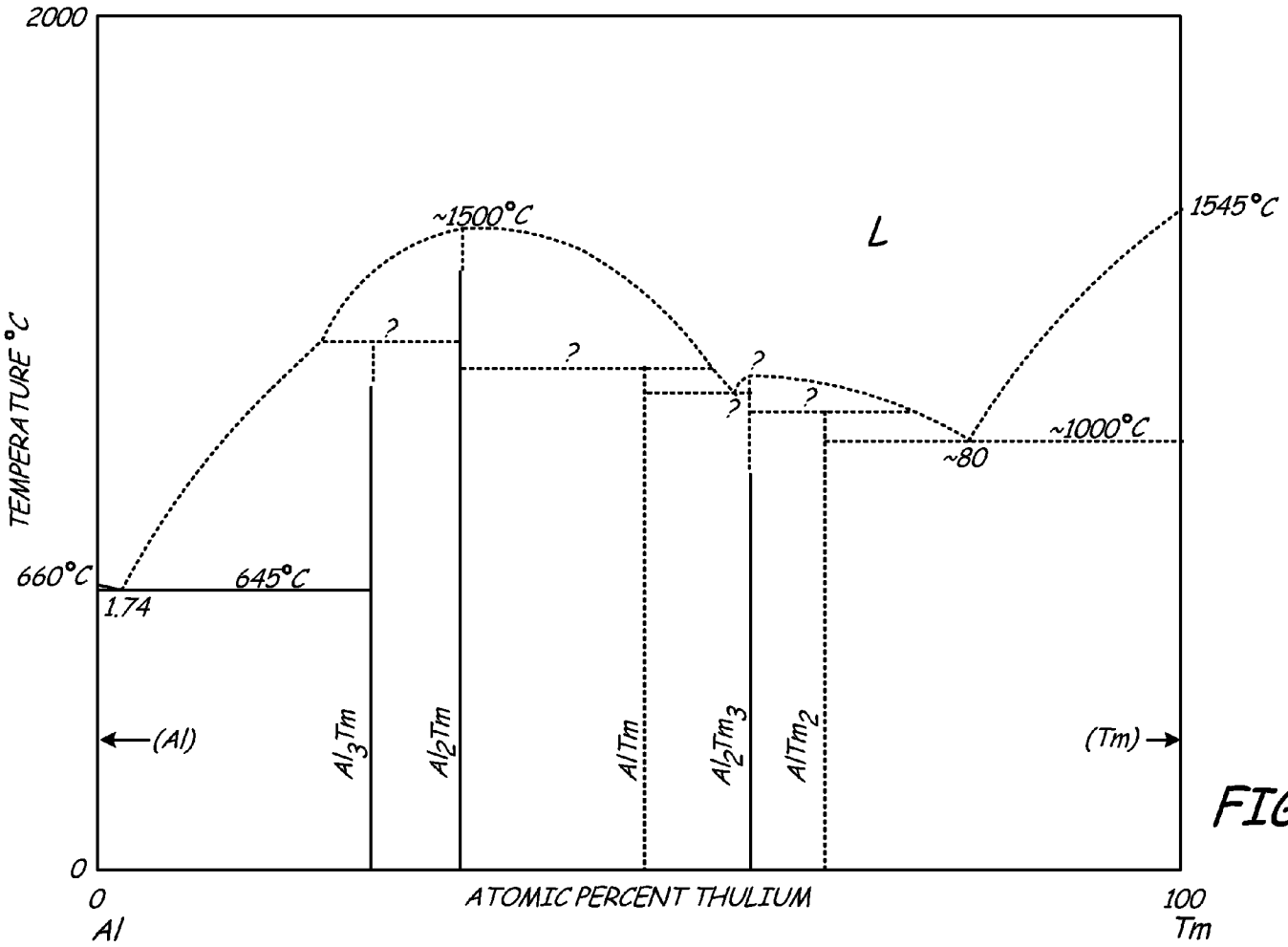
FIG. 3 is an aluminum thulium phase diagram.

The amount of thulium present in the alloys of this invention, if any, may vary from about 0.1 to about 15 weight percent, more preferably from about 0.2 to about 10 weight percent, and even more preferably from about 0.4 to about 6 weight percent. The Al—Tm phase diagram shown in FIG. 3 indicates a eutectic reaction at about 10 weight percent thulium at about 1193° F. (645° C.). Thulium forms metastable $Al_3Tm$ dispersoids in the aluminum matrix that have an $L1_2$ structure in the equilibrium condition. The $Al_3Tm$ dispersoids have a low diffusion coefficient which makes them thermally stable and highly resistant to coarsening. Aluminum alloys with less than 10 weight percent thulium can be quenched from the melt to retain thulium in solid solution that may precipitate as dispersed metastable $L1_2$ intermetallic $Al_3Tm$ following an aging treatment. Alloys with thulium in excess of the eutectic composition can only retain Tm in solid solution by rapid solidification processing (RSP) where cooling rates are in excess of about $10^{3}$° C./second.

Figure 4:
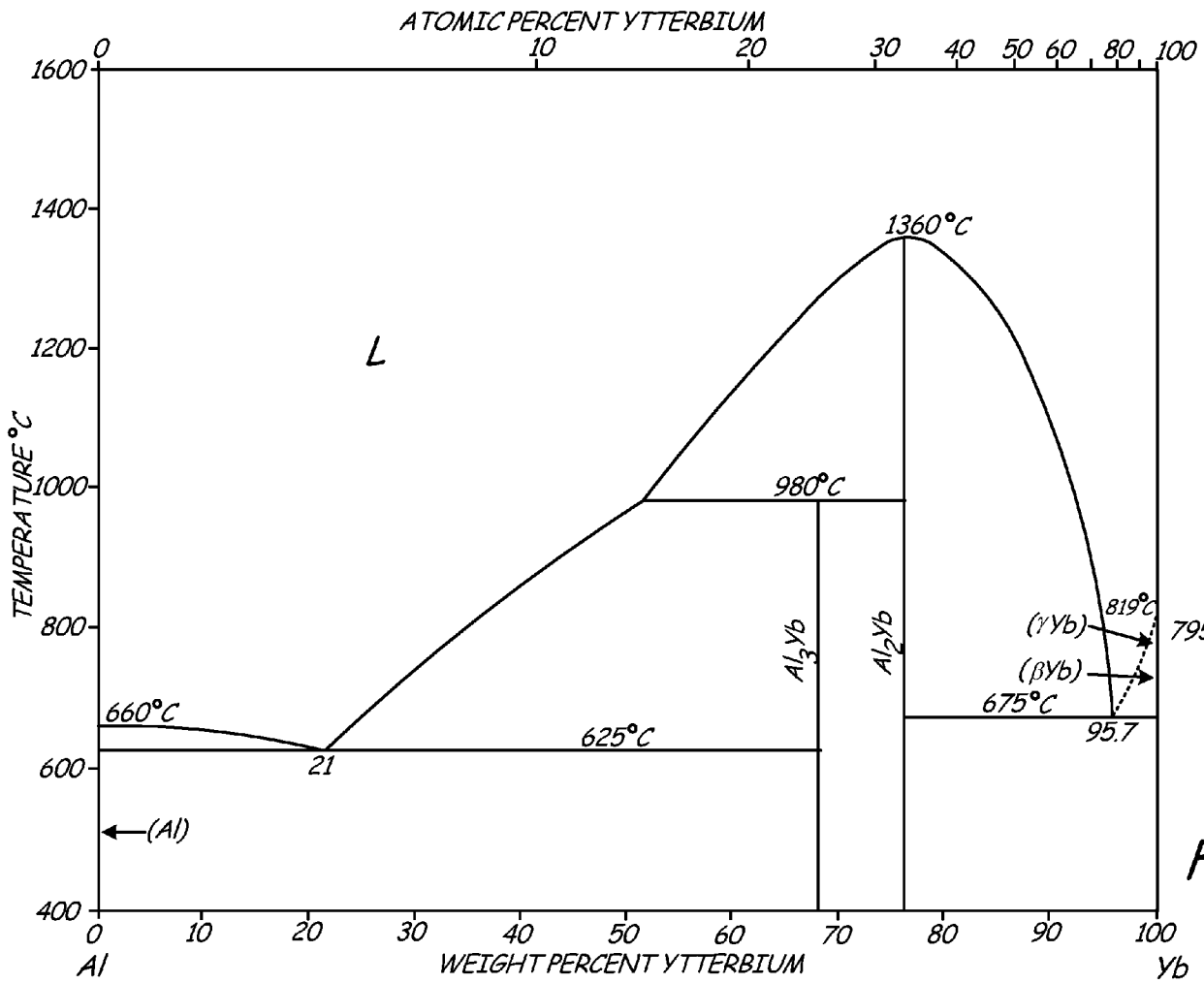
FIG. 4 is an aluminum ytterbium phase diagram.

The amount of ytterbium present in the alloys of this invention, if any, may vary from about 0.1 to about 25 weight percent, more preferably from about 0.3 to about 20 weight percent, and even more preferably from about 0.4 to about 10 weight percent. The Al—Yb phase diagram shown in FIG. 4 indicates a eutectic reaction at about 21 weight percent ytterbium at about 1157° F. (625° C.). Aluminum alloys with less than about 21 weight percent ytterbium can be quenched from the melt to retain ytterbium in solid solution that may precipitate as dispersed $L1_2$ intermetallic $Al_3Yb$ following an aging treatment. Alloys with ytterbium in excess of the eutectic composition can only retain ytterbium in solid solution by rapid solidification processing (RSP) where cooling rates are in excess of about $10^{3}$° C./second.

Figure 5:
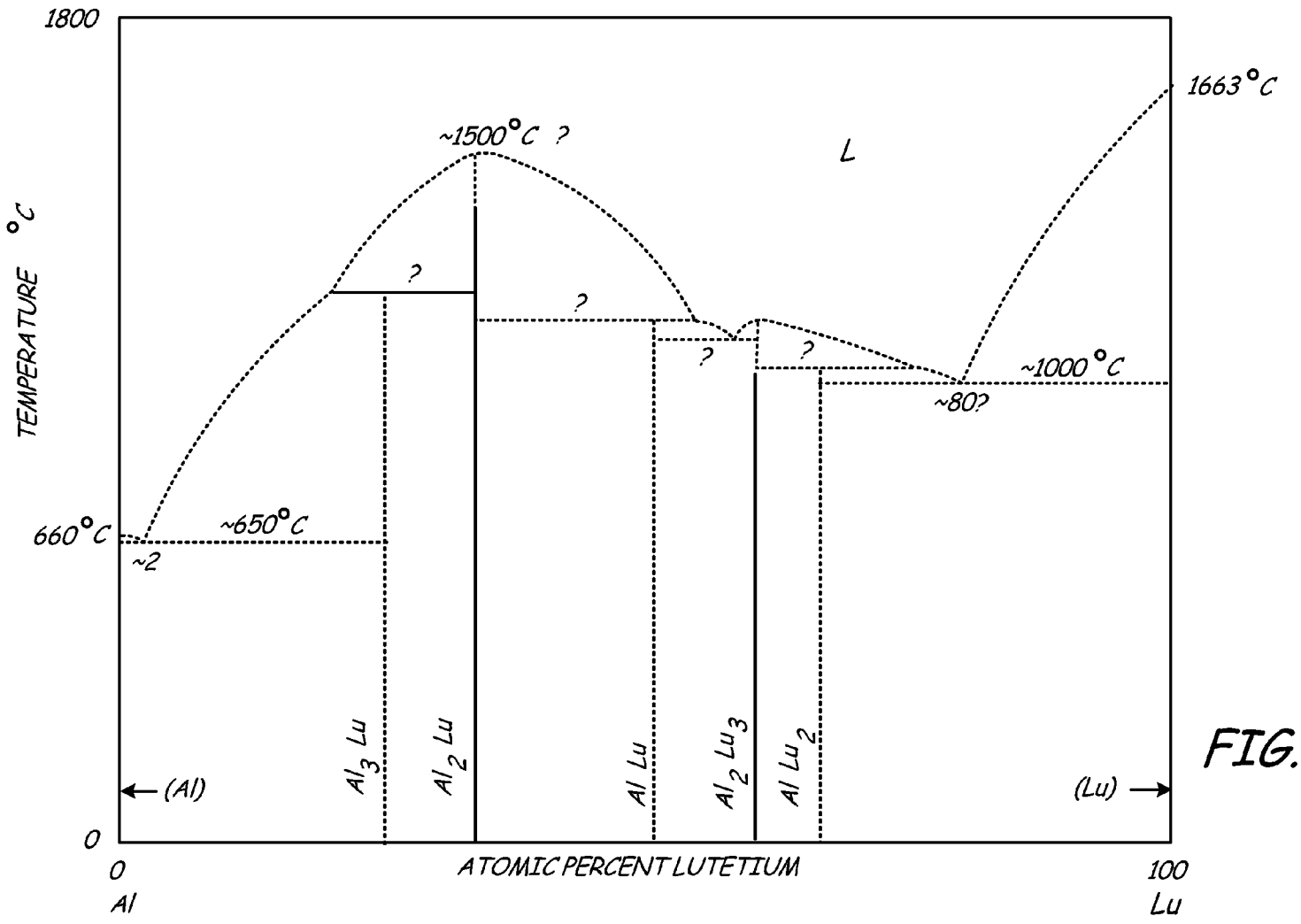
FIG. 5 is an aluminum lutetium phase diagram.

The amount of lutetium present in the alloys of this invention, if any, may vary from about 0.1 to about 25 weight percent, more preferably from about 0.3 to about 20 weight percent, and even more preferably from about 0.4 to about 10 weight percent. The Al—Lu phase diagram shown in FIG. 5 indicates a eutectic reaction at about 11.7 weight percent Lu at about 1202° F. (650° C.). Aluminum alloys with less than about 11.7 weight percent lutetium can be quenched from the melt to retain Lu in solid solution that may precipitate as dispersed $L1_2$ intermetallic $Al_3Lu$ following an aging treatment. Alloys with Lu in excess of the eutectic composition can only retain Lu in solid solution by rapid solidification processing (RSP) where cooling rates are in excess of about $10^{3}$° C./second.

The amount of gadolinium present in the alloys of this invention, if any, may vary from about 0.1 to about 20 weight percent, more preferably from about 0.3 to about 15 weight percent, and even more preferably from about 0.5 to about 10 weight percent.

The amount of yttrium present in the alloys of this invention, if any, may vary from about 0.1 to about 20 weight percent, more preferably from about 0.3 to about 15 weight percent, and even more preferably from about 0.5 to about 10 weight percent.

The amount of zirconium present in the alloys of this invention, if any, may vary from about 0.05 to about 4 weight percent, more preferably from about 0.1 to about 3 weight percent, and even more preferably from about 0.3 to about 2 weight percent.

The amount of titanium present in the alloys of this invention, if any, may vary from about 0.05 to about 10 weight percent, more preferably from about 0.2 to about 8 weight percent, and even more preferably from about 0.4 to about 4 weight percent.

The amount of hafnium present in the alloys of this invention, if any, may vary from about 0.05 to about 10 weight percent, more preferably from about 0.2 to about 8 weight percent, and even more preferably from about 0.4 to about 5 weight percent.

The amount of niobium present in the alloys of this invention, if any, may vary from about 0.05 to about 5 weight percent, more preferably from about 0.1 to about 3 weight percent, and even more preferably from about 0.2 to about 2 weight percent.

In order to have the best properties for the fine grain matrix of this invention, it is desirable to limit the amount of other elements. Specific elements that should be reduced or eliminated include no more than about 0.1 weight percent iron, 0.1 weight percent chromium, 0.1 weight percent manganese, 0.1 weight percent vanadium, and 0.1 weight percent cobalt. The total quantity of additional elements should not exceed about 1% by weight, including the above listed impurities and other elements.

2. Spray Deposition of $L1_2$ Aluminum Alloys

Spray deposition is similar to gas atomization formation of powder, in that metal droplets are formed by the interaction of a high pressure gas stream with a secondary stream of molten metal. The gas atomizes the metal into molten droplets and accelerates the droplets. In powder production the droplets are allowed to solidify and are collected in a collection chamber. In spray forming, the stream of molten droplets impacts a target in a semi-molten state (mushy state) before they solidify to produce a solid near net shape. The benefits of spray forming or spray deposition, as it is sometimes referred to, are first, the process results in near net shaped product directly from the melt rather than going through a series of process steps including powder canning, long degassing time and consolidation of powder used in a powder metallurgy process and thereby eliminating a number of intermediate processes usually involved in forming metal parts. Secondly, the rapid solidification rate causes high solute supersaturation that, in the case of $L1_2$ aluminum alloys, results in maximizing the amount of $L1_2$ strengthening dispersoid content in the alloys. Thirdly, the rapid solidification rate minimizes alloy segregation in the billet. An additional advantage of spray forming is that nonmetallic materials, e.g. ceramics can be injected into the molten metal spray that are incorporated into the final billet as an additional strengthening dispersion.

The spray forming process is described in detail in U.S. Pat. No. 4,938,275 Leatham et al. and is included herein in entirety. The patent is assigned to Osprey Metals Ltd. and is commonly called the Osprey process by those skilled in the art.

Figure 6:
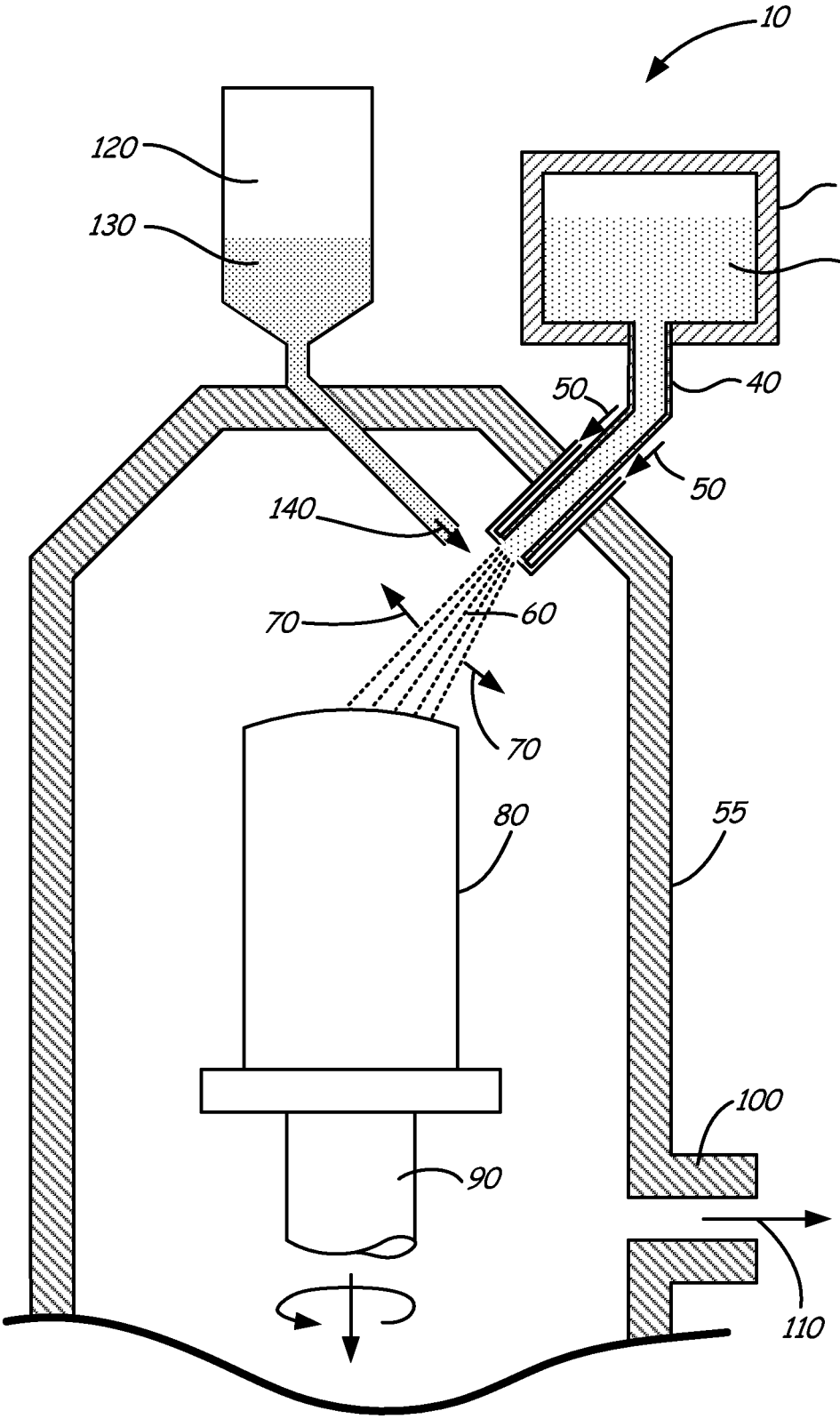
FIG. 6 is a schematic diagram of a vertical spray forming process.

A schematic of typical vertical spray forming process 10 is shown in FIG. 6. Melt 30 contained in furnace 20 flows through feed tube 40 into spray chamber 55. Before melt 30 enters spray chamber 55 it is impacted by atomizing gas 50, which breaks up the melt stream into spray 60 of droplets which impinge on and enlarge billet 80. Billet 80 is supported by base 90 which moves rotationally and descends as billet 80 grows under droplet spray 60. Spray 60 moves in an oscillatory motion indicated by arrows 70 to affect uniform deposition of spray 60 on billet 80. Deposition parameters of spray 60, oscillatory motion 70 and rotation and descending rate of base 90 all need to coordinate to maintain near net shape of billet 80 during spray forming.

As gas builds up in spray chamber 55 during deposition, pressure in spray chamber 55 is controlled by gas exiting exhaust port 100 as indicated by arrow 110.

An added benefit of spray forming is that particulates such as ceramic powder can be added to spray 60 to provide additional strengthening. This process is indicated by particle reservoir 120 holding particles 130 and particle stream 140 entering spray 60 as spray forming proceeds.

Control of the following process parameters are critical to successful billet formation: melt superheat, melt flow rate, gas pressure, spray motion, spray height (distance between gas nozzles 50 and substrate 80) and substrate 90 motion (rotation rate and withdrawal rate). In spray forming, any material that can withstand the thermal spray environment without causing any reaction with aluminum to form undesirable intermetallic particles can be used as a substrate material. Stainless steel is preferred over other materials for a substrate due to its availability, high strength and inability to form intermatallic particles upon contact with aluminum.

Discussion of Processing Parameters

Processing parameters are critical for forming solid billets with low porosity and high structural integrity. Important processing parameters include, among others, metal flow rate, superheat temperature, gas pressure, spray height, metal poring temperature, metal stream diameter, substrate preheat, atomizing gas, substrate rotation, substrate size, deposit thickness and deposit length.

Metal flow rates of about 5 lb/min (2.5 Kg/min) to about 50 lb/min (25 Kg/min) are preferred at superheat temperatures of about 150° F. (66° C.) to about 200° F. (93° C.). Lower flow rate results in finer powder and higher flow rate gives coarser powder for a given amount of gas and metal superheat. Finer powder is beneficial; however, in order to produce dense deposits due to good bonding with other powder particles, the metal powder needs to be in a semimolten stage instead of being completely solid. Higher metal flow rate results in relatively coarser powder which takes longer to solidify. Very high flow rate is undesirable because it provides droplets that remain completely liquid until they impact the substrate. The metal flow rate range given above provides good bonding characteristics resulting in dense deposits.

Gas pressures of about 80 psi (0.55 MPa) to about 500 psi (3.45 MPa) are preferred for the alloys disclosed herein. Lower gas pressure gives larger powder size and higher gas pressure results in finer powder size for a given metal flow rate. Lower gas pressure is still more preferred for spray deposition because it produces slightly coarser powder which remains in semi molten stage which is desirable for good bonding. However, in order to produce good properties the microstructure needs to be fine which is derived from finer powder size. Therefore, it is required to produce powder with sizes which contain an adequate fraction of liquid in order to produce balanced properties.

Fractions of liquid in atomized droplets of about 10 percent to about 50 percent are preferred for the alloys disclosed herein. It is extremely important to retain liquid in droplets before the powder is impacted to the substrate to allow good bonding with other powder particles. If the liquid fraction is too high, it will stick better with other powder. However, the properties will be inferior equivalent to cast products. If the liquid fraction is too low, the powder will not stick together. It is most preferred to have an adequate amount of liquid in droplets in order to produce dense deposits with good mechanical properties.

Spray heights of about 20 in (508 mm) to about 27 in (686 mm) are preferred for the alloys discussed herein. Spray height is the distance between the nozzle and where the metal stream impacts the substrate. Droplets solidify by liberating heat to the atomizing gas by convection. As the spray height is increased, powder particles have more time for solidification before they impact the substrate which reduces bonding of the powder to the substrate. Lower spray height allows less time for the powder to travel before it can solidify and therefore the droplet has a higher liquid fraction. The range given above for spray heights provides good bonding characteristics of the powder resulting in dense deposits.

Metal pouring temperatures of about 1400° F. (760° C.) to about 2200° F. (1204° C.) are preferred for the alloys discussed herein. Higher metal pouring temperature provides finer powder particle sizes due to more efficient disintegration of the metallic stream. Lower metal pouring temperature provides larger powder size. The metal pouring temperature range given above is wide because two different alloys have considerable differences in melting characteristics based on their compositions. The above metal pouring temperature range provides powders with good bonding characteristics resulting in dense deposits.

Metal stream diameters of about 4 mm to about 12 mm are preferred for the alloys discussed herein. Metal stream diameter controls the molten metal flow rate. Small metal stream diameters provide finer powder particles for a given gas pressure due to higher energy available for more efficient disintegration of metal stream. Too small metal stream diameters can create problems due to plugging of the nozzle. Large metal stream diameters provide large powder size due to inefficient break up of the metallic stream by the same amount of gas which was used for small metal stream diameter. The above range for metal stream diameters provides powder with good bonding characteristics resulting in dense deposits.

Substrate preheats of about 500° F. (260° C.) to about 800° F. (477° C.) are preferred for the alloys discussed herein. Substrate preheating improves the bonding of powder particles and produces dense deposits by reducing porosity. In addition, substrate preheat improves closer contact between the deposited metal and the substrate which makes it difficult for oxygen to penetrate. While it is hard to keep substrate temperatures too high because the atomizing gas cools off the substrate, it is desirable to heat the substrate. If the substrate is not hot, the first layer of metal that gets deposited will have a very fine microstructure because it takes away the heat more efficiently. However, subsequent layers which are deposited have coarser microstructures because the metal powder does not contact with the substrate. Instead, it contacts the hot deposit which can not extract heat quickly. Substrate preheat temperatures given above provide dense deposits.

The atomizing gas is preferred to be nitrogen, argon or helium. Helium has a higher transfer coefficient than those of nitrogen and argon resulting in finer microstructures due to higher cooling rate experienced. Argon provides a finer powder due to more efficient disintegration and is cheaper than helium. Nitrogen provides good powder sizes that are desired for good bonding. Nitrogen is cheaper than argon and helium. Based on the cost and good powder bonding characteristics obtained, nitrogen is even more preferred for spray deposition.

Substrate rotations of about 150 rpm to about 300 rpm are preferred for the alloys discussed herein. Substrate rotation provides uniform deposition of metal powder for making cylindrical products. In order to make different shapes, a substrate needs to be moved in different ways.

Substrate sizes of about 3" diameter to about 6" diameter and about 12" long to about 60" long are preferred for the alloys discussed herein. While it is preferred to use the substrate sizes and lengths described here, other sizes and lengths can be used also.

Deposit thicknesses of about 1" to about 5" and deposit lengths of about 5" to about 50" are preferred for the alloys discussed herein. While the deposit thicknesses and lengths mentioned here are preferred, other sizes can be used also.

Ceramic particles comprised of, but not limited to, SiC, $B_4C$, $TiB_2$, TiC, TiB and $Al_2O_3$ can be introduced to the alloy powder by coinjecting them in the atomization spray to improve the properties. The particle sizes of these reinforcements can range from about 1 micron to about 20 microns and volume fractions can range from about 5 percent to 25 percent. Ceramic reinforcements provide higher modulus, higher strength and higher wear resistance of the $L1_2$ aluminum alloys. However, ductility and fracture toughness often decrease due to lower ductility and fracture toughness of these ceramic reinforcements.

The sprayed deposit can be extruded, forged or rolled to further densify and to produce different shapes. Porosity is observed in the deposit if process parameters are not controlled properly. In that case, hot working including extrusion, forging and rolling is needed to further densify the deposit. In addition, hot working also breaks up the oxide in the deposit, distributes it more uniformly and provides improved mechanical properties. Extrusion, forging and rolling can also be used to produce different shaped components. It is preferred to perform these hot working operations in the temperature range of about 400° F. (204° C.) to about 800° F. (477° C.).

Although a vertical billet is described in FIG. 6 a thermal spray process can be used to form a multitude of shapes such as plates, tubes, strip, etc., and the invention described herein is not meant to be limited to any shape or specific spray forming process.

Although the present invention has been described with reference to preferred embodiments, workers skilled in the art will recognize that changes may be made in form and detail without departing from the spirit and scope of the invention.

The invention claimed is:

1. A method for producing high strength aluminum alloy billets containing $L1_2$ dispersoids comprising:

$Al_3X$ dispersoids wherein X is at least one first element selected from the group consisting of about 0.1 to about 20.0 weight percent erbium, about 0.1 to about 15.0 weight percent thulium, about 0.1 to about 25.0 weight percent ytterbium, and about 0.1 to about 21.0 weight percent lutetium; and at least one second element of about 0.05 to about 2.0 weight percent hafnium;

at least one third element selected from the group consisting of about 4 to about 25 weight percent silicon, about 0.5 to about 3 weight percent lithium, about 0.2 to about 6.5 weight percent copper, about 3 to about 12 weight percent zinc, and about 1 to about 12 weight percent nickel; and the balance substantially aluminum, the method comprising the steps of:

melting an aluminum alloy containing $L1_2$ dispersoid forming elements therein;

forcing the melted alloy through a gas atomization nozzle;

contacting the melted alloy stream leaving the nozzle with a high pressure inert gas stream having a dew point from about −50° F. (−45.5° C.) to about −100° F. (−73° C.) to form a spray of liquid droplets;

directing the spray of liquid droplets at a substrate;

contacting a sufficient quantity of the liquid droplets on a rotating substrate prior to solidification to form a desired quantity of solidified alloy; and removing the alloy from the substrate after solidification in the form of a billet.

2. The method of claim 1, wherein the metal flow rate is about 5 lbs/min (2.3 kg/min) to 50 lbs/min (22.5 kg/min).

3. The method of claim 1, wherein the molten aluminum alloy is heated to a superheat temperature of from about 150° F. (66° C.) to about 250° F. (121° C.).

4. The method of claim 1, wherein the metal pouring temperature is about 1400° F. (760° C.) to about 2200° F. (1205° C.).

5. The method of claim 1, wherein the metal stream diameter is about 0.15 in (4 mm) to about 0.47 in (12 mm).

6. The method of claim 1, wherein the inert gas is selected from at least one of argon, nitrogen and helium.

7. The method of claim 1, wherein the gas pressure is about 80 psi (0.55 MPa) to about 500 psi (3.45 MPa).

8. The method of claim 1, wherein the substrate rotation is about 150 rpm to about 300 rpm.

9. The method of claim 1, wherein the substrate preheat is about 500° F. (260° C.) to about 800° F. (427° C.).

10. The method of claim 1, wherein the fraction of liquid in the atomized droplets is about 10 percent to about 50 percent just before impacting the substrate.

11. The method of claim 1, wherein at least one ceramic particle selected from SiC, $B_4C$, TiC, $TiB_2$, TiB, and $Al_2O_3$ is introduced into the alloy by co-spraying with above aluminum alloy.

12. The method of claim 1, wherein sprayed deposit is extruded, forged and/or rolled at about 400° F. (204° C.) to about 800° F. (427° C.) to further densify the structure by eliminating porosity, improving mechanical properties and producing different shapes of components.

13. A method for producing high strength aluminum alloy billets containing $L1_2$ dispersoids, comprising the steps of:

melting an aluminum alloy containing $L1_2$ dispersoid forming elements therein to a superheat temperature of from about 150° F. (65° C.) to about 250° F. (121° C.), and metal pouring temperature of from about 1400° F. (760° C.) to about 2200° F. (1205° C.) wherein, the $L1_2$ dispersoid forming elements form $Al_3X$ dispersoids wherein X is at least one first element selected from the group consisting of: about 0.1 to about 20.0 weight percent erbium, about 0.1 to about 15.0 weight percent thulium, about 0.1 to about 25.0 weight percent ytterbium, and about 0.1 to about 21.0 weight percent lutetium; and at least one second element of about 0.05 to about 2.0 weight percent hafnium;

the alloy further contains at least one third element selected from the group consisting of about 4 to about 25 weight percent silicon, about 0.5 to about 3 weight percent lithium, about 0.2 to about 6.5 weight percent copper, about 3 to about 12 weight percent zinc, about 1 to about 12 weight percent nickel; and the balance substantially aluminum;

forcing the melted alloy through a confined gas atomization nozzle having a metal stream diameter ranging from about 0.16 in (4 mm) to about 0.47 in (12 mm) at a metal flow rate of about 5 lbs/min (2.3 kg/min) to 50 lbs/min (22.5 kg/min);

contacting the melted alloy leaving the nozzle with an inert gas stream having a dew point from about −50° F. (−45.5° C.) to about −100° F. (−73° C.) at a pressure of 80 psi (0.55 MPa) to about 500 psi to about (3.45 MPa); to form liquid droplets, contacting a sufficient quantity of the liquid droplets containing about 10 percent to about 50 percent liquid on a preheated rotating substrate prior to solidification to form a desired quantity of solidified alloy with the substrate height at about 20 in (508 mm) to about 27 in (686 mm); wherein the substrate rotation is about 150 rpm to about 300 rpm and the substrate preheat is about 500° F. (260° C.) to about 800° F. (427° C.); wherein the substrate size is about 3 in (25.4 mm) diameter to about 6 in (15.2 cm) diameter and about 12 in (30.5 cm) long to about 60 in (152 cm) long at a deposit thickness about 1 in (25.4 mm) to about 5 in (127 mm) and a deposit length of about 6 in (15.2 cm) to about 50 in (127 cm); and removing the alloy from the substrate after solidification into a billet.

14. The method of claim 13, wherein at least one ceramic particle selected from SiC, $B_4C$, TiC, $TiB_2$, TiB, and $Al_2O_3$ is introduced into the alloy by co-spraying with above aluminum alloy.

* * * * *